US006318337B1

(12) United States Patent
Pursifull

(10) Patent No.: US 6,318,337 B1
(45) Date of Patent: Nov. 20, 2001

(54) ELECTRONIC THROTTLE CONTROL

(75) Inventor: Ross Dykstra Pursifull, Dearborn, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/575,097

(22) Filed: May 19, 2000

(51) Int. Cl.[7] ..... F02D 11/10
(52) U.S. Cl. ..... 123/396; 123/399
(58) Field of Search ..... 123/337, 361, 123/396, 397, 398, 399, 400; 251/305

(56) References Cited

U.S. PATENT DOCUMENTS

| | | | | |
|---|---|---|---|---|
| 5,115,396 | | 5/1992 | Keegan . | |
| 5,159,831 | | 11/1992 | Kitagawa et al. . | |
| 5,204,816 | | 4/1993 | Wright et al. . | |
| 5,255,653 | | 10/1993 | Ironside et al. . | |
| 5,775,293 | | 7/1998 | Kresse . | |
| 5,809,966 | * | 9/1998 | Streib | 123/399 |
| 5,906,185 | * | 5/1999 | Ishida et al. | 123/399 |
| 5,975,051 | * | 11/1999 | Yamada et al. | 123/396 |
| 5,983,860 | | 11/1999 | Kitamura et al. . | |
| 6,152,108 | * | 11/2000 | Adachi et al. | 123/399 |
| 6,157,888 | * | 12/2000 | Suzio et al. | 701/110 |
| 6,164,623 | * | 12/2000 | Ito et al. | 251/305 |
| 6,170,461 | * | 1/2001 | Pursifull | 123/337 |
| 6,240,899 | * | 6/2001 | Yamada et al. | 123/396 |

FOREIGN PATENT DOCUMENTS

253544 * 10/1989 (JP) ..... F02D/41/20

* cited by examiner

*Primary Examiner*—Tony M. Argenbright
*Assistant Examiner*—Hai Huynh
(74) *Attorney, Agent, or Firm*—Quarles & Brady LLP

(57) ABSTRACT

A throttle control apparatus and method is disclosed in a vehicle having a throttle valve with a default position intermediate a fully-closed position and a fully-open position, and a spring mechanism coupled to the throttle valve that creates torque to move the throttle valve toward the default position in the absence of other torque. The throttle control apparatus includes an actuator for generating torque to open and close the throttle valve in response to a control signal, wherein the actuator is attached to the throttle valve by a mechanical coupling having lash. The throttle control apparatus also includes a processor in communication with the actuator, the processor generating the control signal based upon a command signal. The processor executes a stored program including a portion to compare a new value of the command signal with a prior value of the command signal, and to generate the control signal as a function of the deviation between the new and prior values of the command signal.

20 Claims, 4 Drawing Sheets

ELECTRONIC THROTTLE CONTROL

FIELD OF THE INVENTION

The present invention relates to electronically controlled throttles for vehicle engines. In particular, the present invention relates to the controlling of throttles that are spring biased towards a fast-idle default position.

BACKGROUND OF THE INVENTION

A throttle controls the flow of air, or air and fuel, inducted into an internal combustion engine, and thereby controls the power produced by the engine. Engine power defines the speed of the engine or vehicle to which it is attached, under a given load condition, and thus, reliable control of the throttle setting is important.

In prior art mechanical systems, a direct mechanical linkage controlled the throttle, typically in the form of a cable running from the accelerator pedal, operable by the user of the vehicle, to the throttle valve. Although mechanical linkages are simple and intuitive, they are not readily adapted to electronic control of an engine such as may be desired in sophisticated emissions reduction systems or for features such as automatic vehicle speed control. For these purposes, the mechanical linkage may be replaced with electrical wiring carrying throttle signals from a position sensor associated with the accelerator pedal to a throttle controller operating a throttle actuator (typically an electric motor) for actuating the throttle valve.

While electronic control without mechanical linkages allows for the introduction of a variety of desirable control features, electronic control also makes the operation of the throttle dependent upon the throttle signals to the throttle controller, which controls the throttle actuator. These throttle signals may pick up errors due to noise or otherwise. Those errors can have undesirable effects on the control of the throttle, as discussed below.

As shown in FIG. 1 (Prior Art), a typical throttle includes a conduit, through which air (or an air-fuel mixture) flows, and a rotatable throttle plate that in part determines the flow rate based on its position within the conduit. In between a closed position, in which the throttle plate prevents nearly all flow through the conduit, and a wide-open position, in which the throttle plate allows a maximum flow rate, there is typically a default position for the throttle plate. The default position is a position of the throttle plate in which a relatively small flow rate is allowed (i.e., where the throttle plate is closer to closed than open).

Under normal operating conditions, the position of the throttle plate is positioned by the throttle actuator (i.e., electric motor). The throttle actuator is typically coupled to the throttle plate by a pair of gears in between which exists lash. (In other cases, the throttle actuator and throttle plate can be coupled by other linking elements that also have lash, such as a belt.) However, the throttle plate is also coupled to a spring mechanism which biases the throttle plate towards the default position. If for some reason the throttle actuator is unable to control the position of the throttle plate (i.e., the throttle actuator produces no output torque), the spring mechanism moves the throttle plate to the default position. Because there is a small amount of flow through the conduit in the default position, the vehicle remains (at least partly) operational when this occurs.

Although the spring mechanism is necessary for allowing partial operation of the vehicle when the throttle actuator is malfunctioning, the spring mechanism complicates the electronic control of the throttle. Proper control of the throttle under normal operating conditions (i.e., when the throttle actuator is properly operating) requires that the throttle actuator compensate for (i.e., counteract) the torque of the spring mechanism. Typically, this compensation is effected by the introduction, into the throttle signals, of a feedforward component.

Generation of the proper feedforward component when the throttle plate is near the default position is difficult, however, for two reasons. As shown in FIG. 2 (Prior Art), the torque provided by the spring mechanism changes in a discontinuous manner when the throttle plate crosses over the default position. Additionally, because the spring mechanism biases the throttle plate in opposite directions when the throttle plate is on opposite sides of the default position, the gears coupling the throttle plate and the throttle actuator experience a relative shift due to the gear lash as the throttle plate moves through the default position.

Because of the interaction of the spring mechanism, the gear lash and the feedforward component, exact control of the positioning of the throttle plate near the default position is difficult, and undesirable fluctuation of the throttle plate can occur near the default position. This particularly becomes a problem if noise (i.e., duty cycle variation) occurs within the throttle command signal when the throttle plate is at or very close to the default position, such that the throttle signals are effectively commanding the throttle plate to shift back and forth across the default position. Under these circumstances, the throttle plate can experience rapid, undesirable fluctuation that can result in annoying rattling of the throttle plate.

SUMMARY OF THE INVENTION

The present inventor has recognized that the rapid fluctuation and rattling of the throttle plate is caused by the operation of the feedforward component of the throttle control signal while the throttle plate is positioned near the default position, at which there are discontinuities due to operation of the spring mechanism and the gear lash. Thus, the rapid fluctuation and rattling of the throttle plate can be reduced by modifying the throttle control signal.

The present invention therefore relates to a throttle control apparatus in a vehicle having a throttle valve with a default position intermediate a fully-closed position and a fully-open position, and a spring mechanism coupled to the throttle valve that creates torque to move the throttle valve toward the default position in the absence of other torque. The throttle control apparatus includes an actuator for generating torque to open and close the throttle valve in response to a control signal, wherein the actuator is attached to the throttle valve by a mechanical coupling having lash. The throttle control apparatus further includes a processor in communication with the actuator. The processor generates the control signal based upon a command signal. The processor executes a stored program including a portion to compare a new value of the command signal with a prior value of the command signal, and to generate the control signal as a function of the deviation between the new and prior values of the command signal.

The present invention additionally relates to a throttle control method in a vehicle having a throttle valve with a default position intermediate a fully-closed position and a fully-open position, and a spring mechanism coupled to the throttle valve that creates torque to move the throttle valve toward the default position in the absence of other torque. The throttle control method includes receiving a command signal at a processor, comparing a new value of the command signal with a prior value of the command signal at the processor, and generating a control signal at the processor, wherein the control signal is a function of the deviation between the new and prior values of the command signal. The throttle control method further includes providing the control signal to an actuator that is attached to the throttle valve, with lash existing between the actuator and the throttle valve, and generating torque at the actuator to open and close the throttle valve in response to the control signal.

The present invention further relates to a vehicle comprising a throttle valve with a default position intermediate a fully-closed position and a fully-open position. The vehicle includes a restoring means coupled to the throttle valve for creating torque to move the throttle valve toward the default position in the absence of other torque, a torquing means attached to the throttle valve for generating torque to open and close the throttle valve in response to a control signal, wherein lash exists between the torquing means and the throttle valve, and a processing means, which is in communication with the torquing means. The processing means executes a stored program to compare a new value of a command signal with a prior value of the command signal, and to generate the control signal at the processor, wherein the control signal is a function of the deviation between the new and prior values of the command signal.

DETAILED DESCRIPTION OF THE PREFERRED EMBODIMENT

Figure 1:
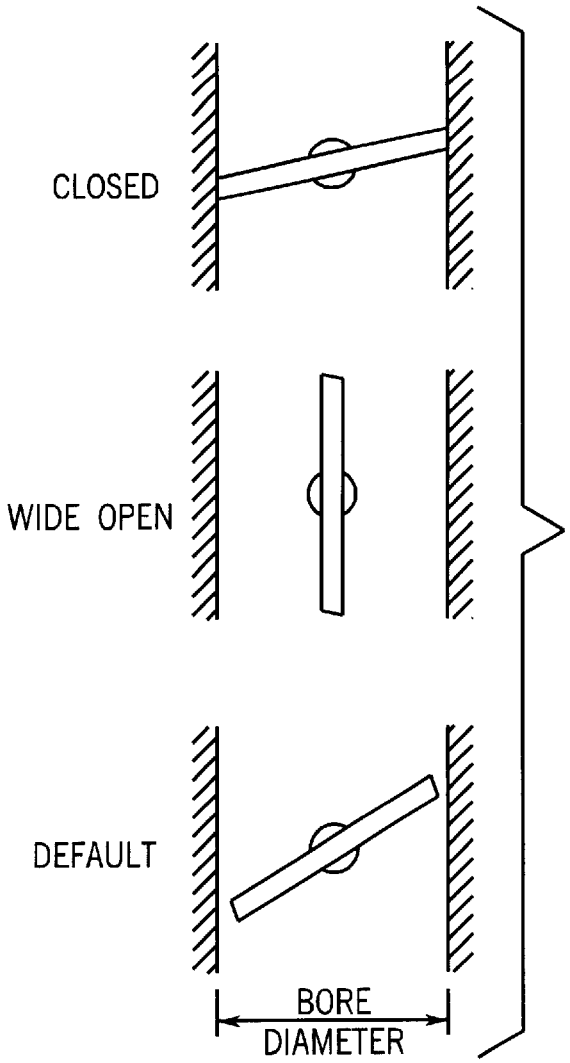
FIG. 1 PRIOR ART
FIG. 1 is cross-sectional views of a throttle including a throttle plate within a conduit, in which the throttle plate is shown to be in closed, wide-open and default positions (Prior Art)
Figure 2:
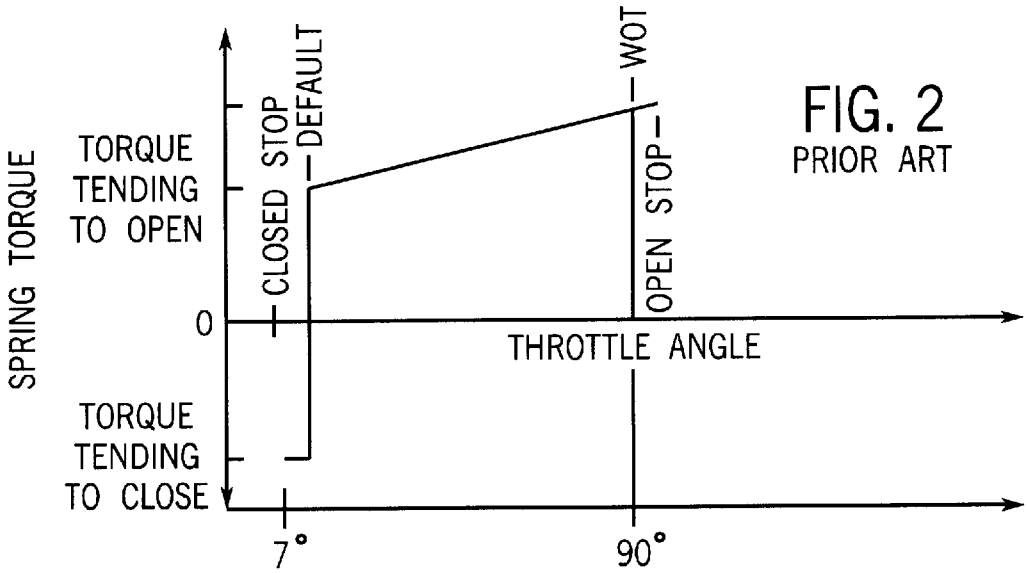
FIG. 2 PRIOR ART
FIG. 2 is a graph of spring torque versus throttle plate position (throttle angle) for a spring mechanism that biases the throttle plate of FIG. 1 toward the default position (Prior Art)
Figure 3:
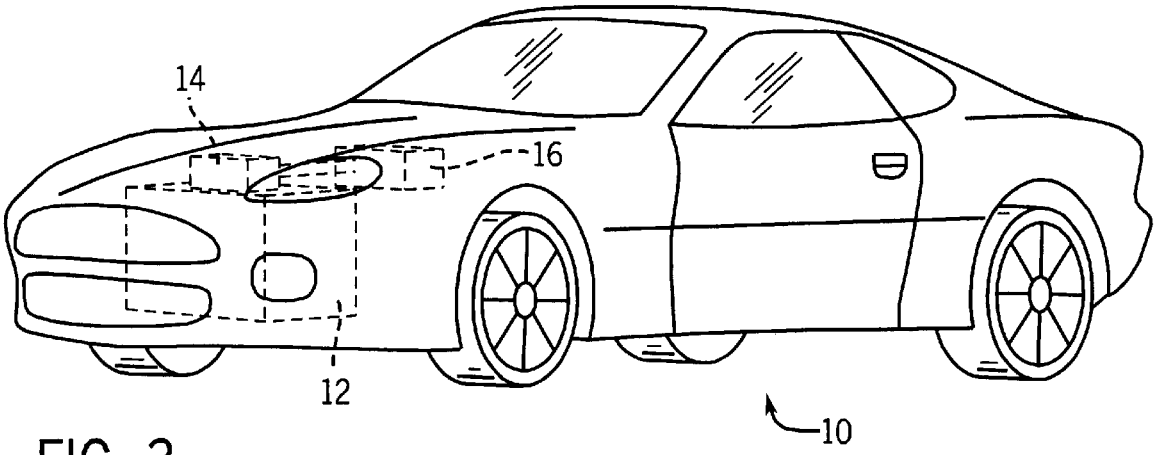
FIG. 3 is a perspective view of an exemplary vehicle having (in phantom) an engine, a throttle assembly, and an electronic throttle control system in accordance with the present invention.

Referring now to FIG. 3, a vehicle having an engine 12, a throttle assembly 14, and an electronic throttle control system 16 is shown. Vehicle 10 may be any one of a variety of types of vehicles having internal combustion engines or other types of engines that employ throttles, including automobiles, trucks, busses, construction vehicles, agricultural vehicles, and other vehicles or stationary power units.

Figure 4:
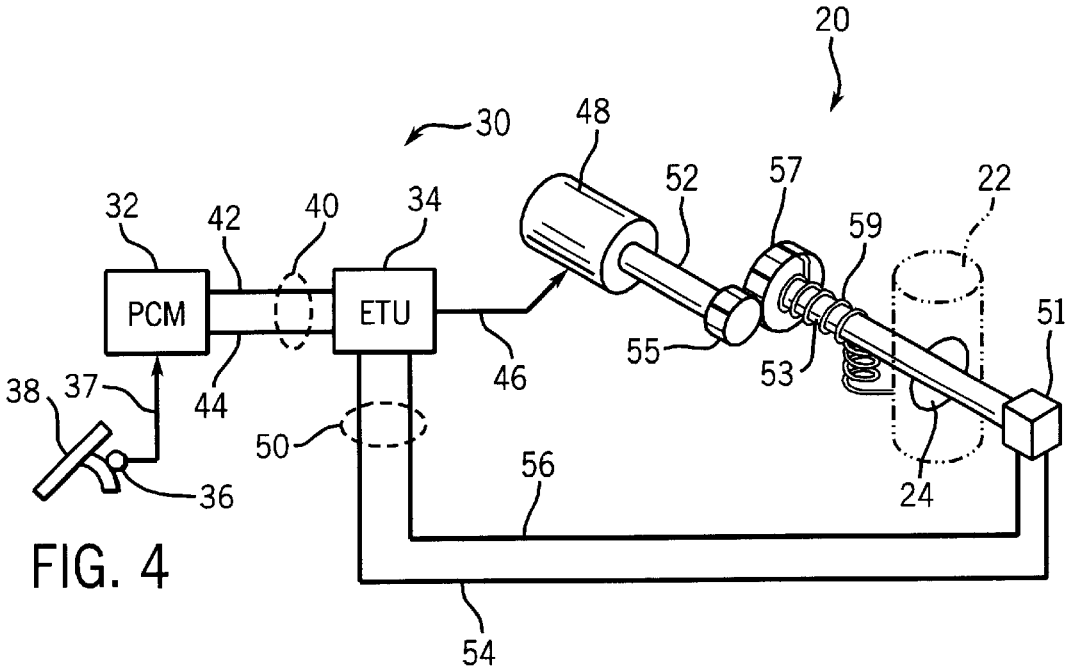
FIG. 4 is a block diagram of an exemplary throttle assembly and electronic throttle control system in accordance with the present invention.

Turning to FIG. 4, elements of an exemplary throttle assembly 20 and an exemplary electronic throttle control system 30 are shown. Throttle assembly 20 includes a conduit (e.g., a tube, pipe or other channel) 22 through which air or an airfuel mixture is to flow. Positioned within conduit 22 is a throttle plate (or simply throttle) 24, which is elliptical in shape and rotates within conduit 22 (which is cylindrical). Throttle plate 24 is capable of rotating to a fully-closed position, a fully-open position and a variety of other positions including a default position. In alternate embodiments, conduit 22 may take on any number of different shapes; in such cases, throttle plate 24 also takes on a corresponding shape such that the throttle plate may, when rotated to a closed position, completely close off (or nearly completely close off) the conduit.

Electronic throttle control system 30 includes a powertrain control module (PCM) 32 that is coupled to an electronic throttle unit (ETU) 34. PCM 32 receives an operator input signal 37 from a pedal position sensor 36, which indicates the angular deflection of an accelerator pedal 38 as actuated by the vehicle driver. PCM 32 provides a throttle command signal 40 on a first channel 42 and also on a second channel 44 to ETU 34. Throttle command signal 40 is generated based upon operator input signal 37 and indicates a desired throttle position. First and second channels 42, 44 can be provided on separate conductors, so as to reduce the chance of loss of both signals from a conductor break, or can be time or frequency multiplexed on a single conductor. In alternate embodiments, throttle command signal 40 is provided from PCM 32 to ETU 34 via only a single channel. Also, in alternate embodiments, PCM 32 provides throttle command signal 40 based on information other than (or in addition to) operator input signal 37 (e.g., the throttle command signal can be completely generated by a computer in an automatic mode of control).

Based upon throttle command signal 40, ETU 34 provides an output signal (typically a voltage signal) 46 to a throttle actuator 48, for example, an electric motor. Throttle actuator 48 is coupled to throttle plate 24 by a first rotating shaft 52 and a second rotating shaft 53, which in turn are coupled by a first gear 55 and a second gear 57. Gear lash exists between first and second gears 55, 57. Consequently, when the driving gear (that gear which is at a particular time delivering torque to the other gear) switches direction, it does not engage the other gear immediately upon switching direction, but instead must rotate a certain distance before engaging the other gear. In alternate embodiments, throttle actuator 48 can be coupled to throttle plate 24 by other elements that also have lash, such as a belt.

Output signal 46 is based upon (or even equivalent to) throttle command signal 40, and is provided to cause throttle actuator 48 to rotate throttle plate 24 to the desired throttle position. Also coupled to throttle plate 24 are one or more sensors 51 for generating a throttle position signal 50 indicative of actual throttle position, and providing the throttle position signal to ETU 34 via first feedback channel 54 and a redundant feedback channel 56. The information in throttle position signal 50 provided via first and redundant feedback channels 54, 56 is used by ETU 34 for closed loop control of throttle plate 24 by adjusting output signal 46. Feedback channels 54, 56 can be provided on separate conductors, so as to reduce the chance of loss of both signals from a conductor break, or can be time or frequency multiplexed on a single conductor.

Each of the PCM 32 and ETU 34 preferably is (or includes) a microcontroller or other computer processor having memory. The memory of PCM 32 includes a computer program for generating throttle command signal 40 indicative of the commanded throttle position based upon operator input signal 37. The memory of ETU 34 includes a computer program for monitoring and controlling the operation of throttle plate 24 in response to throttle command signal 40. Specifically, ETU 34 monitors the difference between the actual throttle position as indicated by throttle position signal 50 and the commanded throttle position as indicated by throttle command signal 40. Based upon the difference between the actual throttle position and the commanded throttle position, ETU 34 then sets output signal 46 to cause throttle plate 24 to adjust towards the commanded throttle position. In alternate embodiments, PCM 32 and ETU 34 can be combined into a single control unit, which performs the functions of the PCM and ETU. Further, in alternate embodiments, PCM 32 and ETU 34 (or the combined controller) are hard-wired rather than microcontroller-based.

Further as shown in FIG. 4, a spring mechanism 59 is coupled to throttle plate 24. Spring mechanism 59, which is coupled directly with second gear 57 (and not directly with first gear 55), biases throttle plate 24 towards the default position. To compensate for the torque of spring mechanism 59, output signal 46 (provided by ETU 34) includes a feedforward component. The torque provided by spring mechanism 59 experiences a change in direction and a discontinuity as throttle plate 24 crosses over the default position. Consequently, the feedforward component of output signal 46 also experiences a change in direction and a discontinuity as throttle plate 24 passes through the default position. Because of the lash between first and second gears 55, 57, the gears can experience a slight relative rotation with respect to one another as they rotate when throttle plate 24 crosses over the default position, both as a result of the spring mechanism 59 and the feedforward component of output signal 46. Consequently, if noise exists on throttle command signal 40 and then is transferred onto output signal 46 while throttle plate 24 is at or near the default position, the throttle plate can experience rapid fluctuation and produce rattling (or other undesirable sounds).

Figure 5:
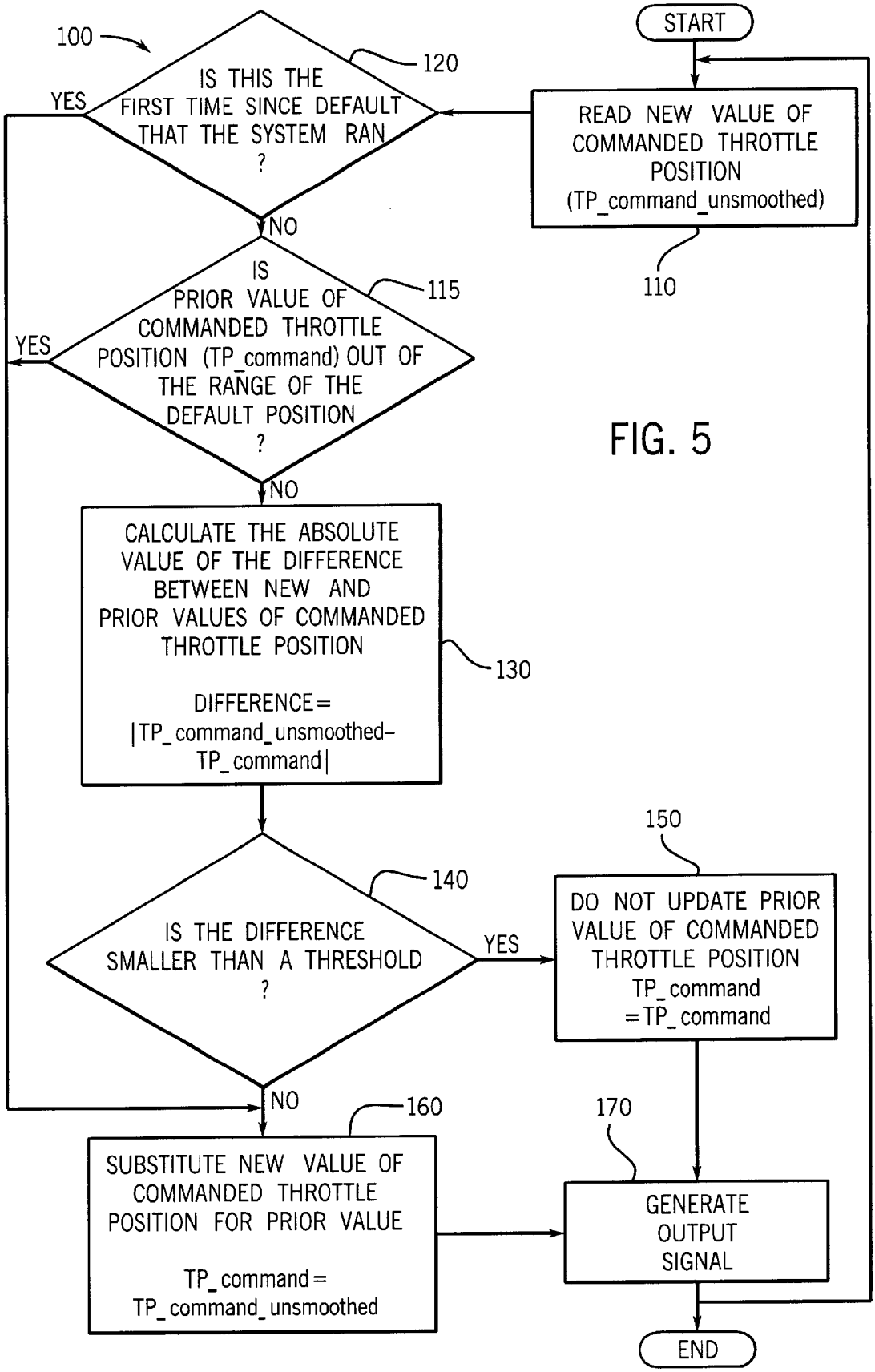
FIG. 5 is a flow chart showing exemplary steps of a first computer algorithm that may be employed in accordance with the present invention.

Turning to FIG. 5, a flow chart 100 showing exemplary steps of a computer algorithm for filtering undesirable noise from throttle command signal 40 is provided. By implementing these steps on ETU 34, undesirable noise from throttle command signal 40 can be removed so that output signal 46 is free of the noise and consequently throttle plate 24 does not experience rapid fluctuation or rattling near the default position. Upon starting, the flow chart begins with step 110, in which a new value of the commanded throttle position (TP_command_unsmoothed) is obtained at ETU 34 (in the form of throttle command signal 40, from PCM 32). Next, at step 120, a determination is made as to whether this is the first time that the algorithm has been run (i.e., whether this is the first cycle through the algorithm). This can be the case either because the processing has just been turned on (i.e., the vehicle was just started), or because a vehicle fault condition has just been corrected. If so, the algorithm proceeds to step 160, such that the new value of the commanded throttle position is used to determine output signal 46. In this case, throttle command signal 40 is not filtered (since there is no basis for determining that the throttle command signal is faulty).

If this is not the first cycle through step 120 of the algorithm, the algorithm proceeds to step 115. Step 115 determines whether a prior value of the commanded throttle position (TP_command, i.e., the value previously received before the new value) commanded throttle plate 24 to move outside the region immediately surrounding the default position. If so, there is no need to filter throttle command signal 40 (since the rapid fluctuation and rattling of throttle plate 24 only occur due to the interaction of the lash with the operation of spring mechanism 59 and the feedforward component of output signal 46 while the throttle plate is at the default position) and so the algorithm proceeds directly to step 160. Again, at step 160, the new value of the commanded throttle position is used to determine output signal 46 (i.e., throttle command signal 40 remains unchanged).

However, if the prior value of the commanded throttle position directed throttle plate 24 to move to a position within the particular range around the default position, filtering of any noise from throttle command signal 40 becomes important for precluding undesirable fluctuation and rattling of the throttle plate. The algorithm thus proceeds to step 130, where the absolute value of the difference between the new value of the commanded throttle position (T_command_unsmoothed) and the prior value of the commanded throttle position (TP_command) is calculated. Then the algorithm proceeds to step 140, which determines whether the absolute value of the difference between the two values is smaller than a threshold. If the difference is smaller than a threshold, this indicates that the change in the commanded throttle position was likely due to noise. Such a change could lead to undesirable fluctuation and rattling of throttle plate 24, and therefore should be filtered from the commanded throttle position. Hence, the algorithm advances to step 150, which maintains the prior value of the commanded throttle position constant instead of updating the commanded throttle position to equal the new value of the commanded throttle position. The change in throttle command signal 40 is filtered from the signal before it is used to generate output signal 46.

If, however, at step 140, the difference is found out not to be smaller than the threshold, the algorithm proceeds to step 160. In step 160, the new value of the commanded throttle position is substituted for the prior value of the commanded throttle position and no filtering is performed. After performing either step 150 or step 160, the algorithm has determined the latest commanded throttle position and therefore proceeds to step 170, in which this commanded throttle position is utilized by ETU 34 as the basis for determining output signal 46. The algorithm then returns to step 110 to read a new value of the commanded throttle position, unless performance of the algorithm is ended.

Figure 6:
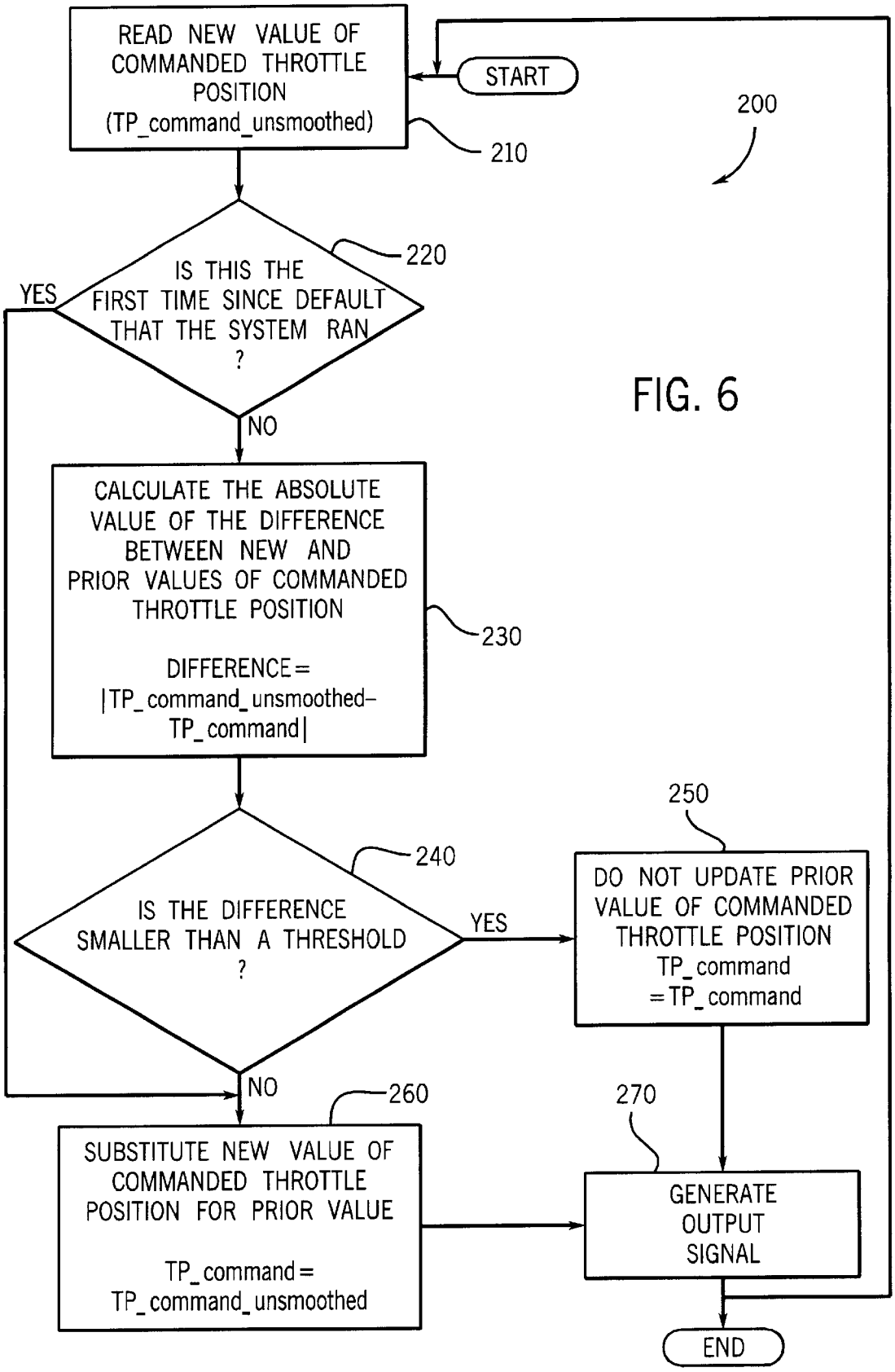
FIG. 6 is a flow chart showing exemplary steps of a second computer algorithm that may be employed in accordance with the present invention.

Referring to FIG. 6, a second flow chart 200 is provided showing exemplary steps of a second computer algorithm that may be performed by ETU 34 to filter throttle command signal 40. Flow chart 200 is identical to flow chart 100 except insofar as it does not include a step paralleling step 115 of flow chart 100. Otherwise, steps 210 through 270 each correspond respectively with steps 110 through 170 of flow chart 100. Because flow chart 200 lacks a step paralleling step 115 of flow chart 100, the algorithm of flow chart 200 does not limit the filtering process to times when the throttle command signal 40 is commanding throttle plate 24 to a position near the default position of the throttle plate. Instead, the algorithm filters throttle command signal 40 at all times regardless of the current position of throttle plate 24.

The algorithms of flow charts 100, 200 are meant to be exemplary. The particular algorithms of flow charts 100, 200 of FIGS. 5 and 6, respectively, can be modified to operate differently under different circumstances. Each of the algorithms has several characteristic parameters than can be adjusted. For example, the period of each algorithm is typically 4 milliseconds (i.e., a new value of the commanded throttle position will be obtained every 4 milliseconds). However, the period/frequency of operation can be speeded-up or slowed-down to correspond with the rapidity of change of throttle command signal 40. Also, the noise threshold of steps 140, 240 typically are set to 0.075% or at least ¾ of a tenth of a degree. Changes in the commanded throttle position that are less than this amount will be filtered from throttle command signal 40 when the filter is operating. Use of this threshold is consistent with allowing control of the position of throttle plate 24 to within 1/10 of a degree. However, other thresholds can be used to allow greater or lesser tolerance of small changes in the commanded throttle position. With respect to step 115 of flow chart 100, the range about the default position can also be set to a variety of levels.

It will occur to those that practice the art that many modifications may be made without departing from the spirit and scope of the invention. For example, other algorithms may be used to filter or otherwise process a throttle command signal to remove noise and consequently reduce undesired throttle fluctuations or rattling. Some of these algorithms employ more complicated tests to provide filtering only when certain patterns of changes occur in the commanded throttle position, or under circumstances where throttle rattling is likely to occur for an extended period of time. Also, multiple algorithms may be used at different times in the system as throttle operation changes over time, or in response to different operational conditions of the vehicle. In order to apprise the public of the various embodiments that may fall within the scope of the invention, The following claims are made:

1. A throttle control apparatus in a vehicle having a throttle valve with a default position intermediate a fully-closed position and a fully-open position, and a spring mechanism coupled to the throttle valve that creates torque to move the throttle valve toward the default position in the absence of other torque, the throttle control apparatus comprising:

an actuator for generating torque to open and close the throttle valve in response to a control signal, wherein the actuator is attached to the throttle valve by a mechanical coupling having lash; and a processor in communication with the actuator, the processor generating the control signal based upon a command signal, the processor executing a stored program including a portion to:

(i) compare a new value of the command signal with a prior value of the command signal, and (ii) generate the control signal as a function of the deviation between the new and prior values of the command signal.

2. The throttle control apparatus of claim 1, wherein the processor sets the control signal equal to the prior value of the command signal when the absolute value of the deviation between the new and prior values of the command signal is less than a predetermined value.

3. The throttle control apparatus of claim 1, wherein the processor sets the control signal equal to the new value of the command signal when the absolute value of the deviation between the new and prior values of the command signal exceeds a predetermined value.

4. The throttle control apparatus of claim 1, wherein the mechanical coupling is a pair of gears, and the lash exists between the gears.

5. The throttle control apparatus of claim 1, wherein the throttle valve includes a sensor, the processor performs closed-loop control of the throttle valve using a signal from the sensor, and the control signal includes a feedforward component configured to counteract the torque of the spring mechanism.

6. The throttle control apparatus of claim 1, wherein the stored program generates the control signal based upon the new value of the command signal if the deviation between the new and prior values of the command signal is greater than a predetermined value.

7. The throttle control apparatus of claim 1 wherein, during an initialization period, the processor generates the control signal without regard to the deviation.

8. The throttle control apparatus of claim 1 wherein, if the stored program is only in a first cycle of execution since a fault occurrence, the processor does not execute the portion of the stored program to compare the new value with the prior value or to generate the control signal based upon the prior value, but rather generates the control signal based upon the new value of the command signal.

9. The throttle control apparatus of claim 1 wherein, if the prior value of the command signal corresponds to a throttle position that is greater than a certain distance from the default position, the processor does not execute the portion of the stored program to compare the new value with the prior value or to generate the control signal based upon the prior value, but rather generates the control signal based upon the new value of the command signal.

10. The throttle control apparatus of claim 1, wherein the actuator is an electric motor.

11. The throttle control apparatus of claim 1, wherein the processor is a microprocessor having a memory in which the stored program is recorded.

12. A throttle control method in a vehicle having a throttle valve with a default position intermediate a fully-closed position and a fully-open position, and a spring mechanism coupled to the throttle valve that creates torque to move the throttle valve toward the default position in the absence of other torque, the throttle control method comprising:

receiving a command signal at a processor;

comparing a new value of the command signal with a prior value of the command signal at the processor;

generating a control signal at the processor, wherein the control signal is a function of the deviation between the new and prior values of the command signal;

providing the control signal to an actuator that is attached to the throttle valve, with lash existing between the actuator and the throttle valve; and generating torque at the actuator to open and close the throttle valve in response to the control signal.

13. The throttle control method of claim 12, wherein the processor sets the control signal equal to the prior value of the command signal when the absolute value of the deviation between the new and prior values of the command signal is less than a predetermined value.

14. The throttle control method of claim 13, wherein the processor sets the control signal equal to the new value of the command signal when the absolute value of the deviation between the new and prior values of the command signal exceeds a predetermined value.

15. The throttle control method of claim 12, further comprising:

generating the control signal based upon the new value of the command signal if the prior value of the command signal corresponds to a throttle position that is greater than a certain distance from the default position.

16. The throttle control method of claim 12, further comprising:

generating the control signal without regard to the deviation during an initialization period.

17. The throttle control method of claim 12, further comprising:

generating the control signal based upon the new value of the command signal during a first cycle of operation after a fault occurrence.

18. A vehicle comprising:

a throttle valve with a default position intermediate a fully-closed position and a fully-open position;

a restoring means coupled to the throttle valve for creating torque to move the throttle valve toward the default position in the absence of other torque;

a torquing means attached to the throttle valve for generating torque to open and close the throttle valve in response to a control signal, wherein lash exists between the torquing means and the throttle valve; and a processing means in communication with the torquing means, the processing means for executing a stored program to:

(i) compare a new value of a command signal with a prior value of the command signal, and (ii) generate the control signal as a function of the deviation between the new and prior values of the command signal.

19. The vehicle of claim 18, wherein the processing means sets the control signal equal to the prior value of the command signal when the absolute value of the deviation between the new and prior values of the command signal is less than a predetermined value.

20. The vehicle of claim 18, wherein the processor sets the control signal equal to the new value of the command signal when the absolute value of the deviation between the new and prior values of the command signal exceeds a predetermined value.

* * * * *

UNITED STATES PATENT AND TRADEMARK OFFICE

CERTIFICATE OF CORRECTION

PATENT NO. : 6,318,337 B1
DATED : November 20, 2001
INVENTOR(S) : Pursifull

It is certified that error appears in the above-identified patent and that said Letters Patent is hereby corrected as shown below:

Column 6,
Line 14, (T_command_unsmoothed) should be -- (TP_command_unsmoothed) --.

Signed and Sealed this

Twenty-first Day of May, 2002

*Attest:*

*Attesting Officer*

JAMES E. ROGAN
*Director of the United States Patent and Trademark Office*